United States Patent [19]

Dreyer

[11] 4,004,440

[45] Jan. 25, 1977

[54] CABLE LOCK FOR SMALL APPLIANCES

[76] Inventor: William Emil Dreyer, 13818 Castle Blvd., No. 101, Silver Spring, Md. 20904

[22] Filed: Mar. 19, 1976

[21] Appl. No.: 668,562

[52] U.S. Cl. ..... 70/15; 70/58

[51] Int. Cl.[2] ..... E05B 73/00

[58] Field of Search ..... 70/57, 58, 14, 15, 18, 70/59–62; 248/203; 211/4–9

[56] References Cited

UNITED STATES PATENTS

| | | | |
|---|---|---|---|
| 3,664,163 | 5/1972 | Foote | 70/58 |
| 3,771,338 | 11/1973 | Raskin | 70/58 |
| 3,859,826 | 1/1975 | Singer | 70/58 |
| 3,910,081 | 10/1975 | Pender | 70/234 |

*Primary Examiner*—Robert L. Wolfe

*Attorney, Agent, or Firm*—Lowe, King, Price & Markva

[57] ABSTRACT

A compact device for locking an article, such as an office machine, to a desk or fixed base comprises a flexible cable secured at one end to a key-operated lock, and at the other end to an anchor block. The anchor block is in turn secured to the desk with a one-way screw. The lock is engageable with a plate member permanently secured to the bottom of the machine. The plate member is step-shaped adjacent the machine so that the lock engaging portion of the member is maintained parallel to and above the surface of the desk. This prevents interference between the bottom of the lock and the desk, and expedites engagement of disengagement of the lock. The cable retains the office machine in proximity to the desk, yet permits the position of the machine to be adjusted to suit the user.

11 Claims, 6 Drawing Figures

CABLE LOCK FOR SMALL APPLIANCES

BACKGROUND OF THE INVENTION

The present invention relates generally to locking devices, and more particularly to a compact locking device for securing office equipment to a desk or other fixed base, yet permitting adjustment of the position of the equipment.

In order to prevent theft, various locking devices are presently being used to secure office equipment, such as typewriters, calculators, photocopiers, etc., to a desk or other fixed base. In one type of prior art device of which I am aware, exemplified by the U.S. Pat. No. 3,707,860 to Singer et al., a bracket attached to the bottom of the equipment is coupled to a securing plate in turn permanently fastened to a mounting base. Although this device is generally effective for preventing theft, the position of the equipment cannot be adjusted to suit the user. This is particularly disadvantageous in the case of a typewriter, where the typist typically adjusts the typewriter to a convenient position on the desk.

In order to permit positioning of the equipment, another type of prior art device, shown in U.S. Pat. No. 3,859,826 to Singer et al., includes a flexible cable connected between a first latching member at the equipment and a second latching member at a fixed base. That device, however, is relatively complex requiring several interlocking parts as well as two distinct locking mechanisms, adding to the cost. Furthermore, if any of the components are misplaced or lost, the locking device cannot be used.

OBJECTIVES OF THE INVENTION

It is accordingly a primary object of this invention to provide a locking device for articles that is simple and compact, and has a minimum number of parts.

Another object of this invention is to provide a new and improved device for locking a piece of equipment to the area of a desk, yet permit adjustment of the position of the equipment on the desk.

A further object of the invention is to provide a new and improved device for securing office equipment to the area of a desk with a long connecting cable so that the equipment may be positioned at any desired location within the length of the cable.

A still further object of the invention is to provide a new and improved device for securing office equipment to the area of a desk, including a plate member permanently secured to the equipment, an anchor block permanently secured to a fixed base, and a lock for securing the anchor block with respect to the plate member.

Another object of the invention is to provide a locking device for office equipment that is inexpensive to manufacture and convenient to use.

SUMMARY OF THE INVENTION

In accordance with the invention, a locking device includes a flexible cable attached at one end to an anchor block, and at the other end to a key-operated lock. The lock is engageable with a plate member permanently secured to the bottom of a piece of equipment. The plate member is step-shaped adjacent the equipment to maintain the lock engaging portion of the plate member parallel to and above the upper surface of the desk supporting the equipment.

Since the free end of the plate member is maintained parallel to and above the surface of the desk, the lock is also maintained above the desk, and this prevents any interference with the desk during engagement and disengagement of the lock with respect to the plate member.

The lock includes a slot for receiving the lock-engaging portion of the plate member. The lock engages a set of ratchet teeth formed along one edge of the plate member, so that the equipment cannot be released without using a key to open the lock.

The anchor block is secured to the fixed base with a screw mounted in an aperture formed in the block. Preferably, a one-way screw is used so that once the anchor block is secured to the fixed base, it cannot be removed using a screwdriver.

Still other objects and advantages of the present invention will become readily apparent to those skilled in this art from the following detail description, wherein I have shown and described only the preferred embodiment of the invention, simply by way of illustration of the best mode contemplated by me of carrying out my invention. As will be realized, the invention is capable of other and different embodiments, and its several details are capable of modifications in various obvious respects, all without departing from the invention. Accordingly, the drawings and description are to be regarded as illustrative in nature, and not as restrictive.

DETAILED DESCRIPTION OF A PREFERRED EMBODIMENT

Figure 1:
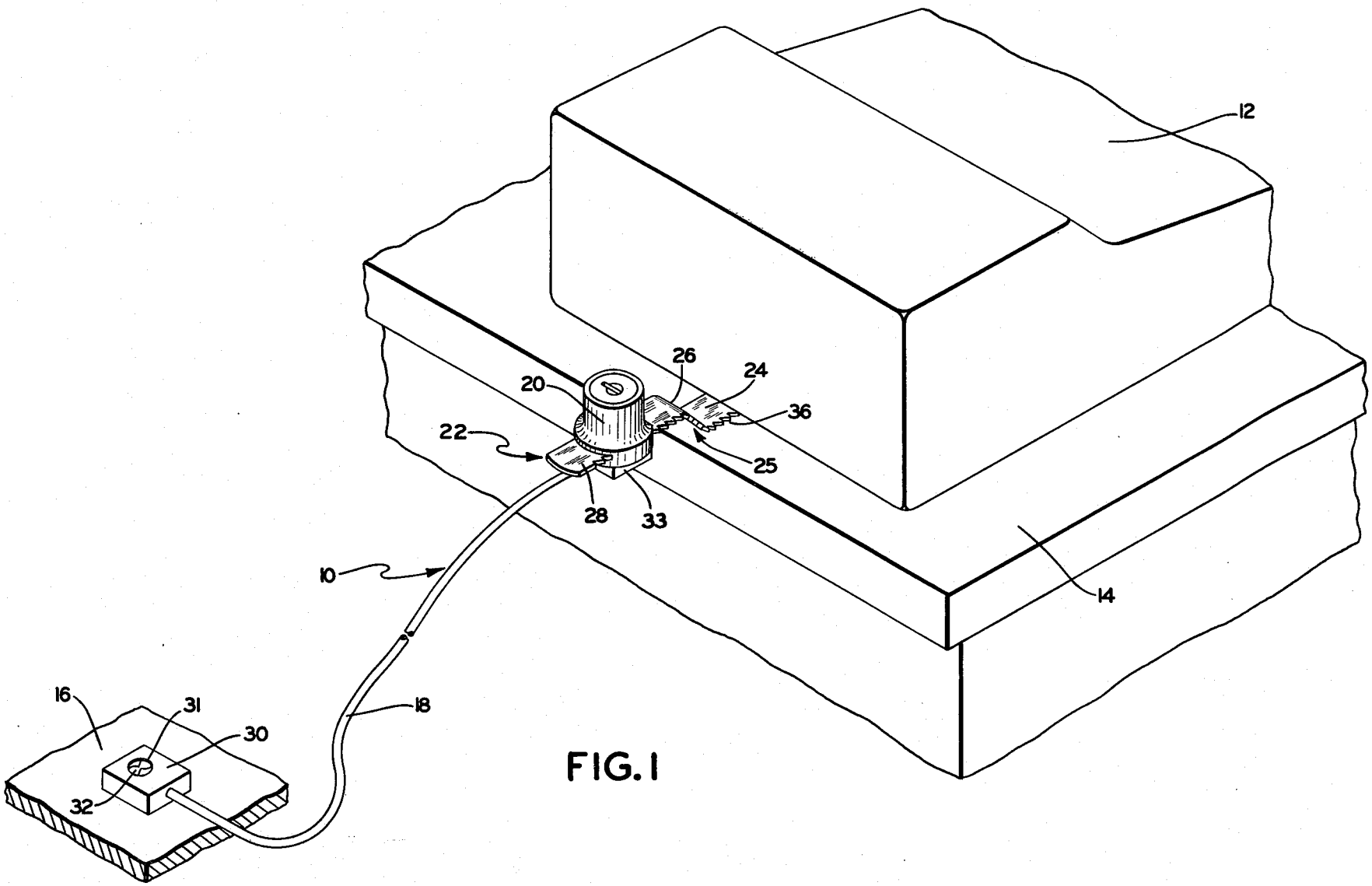
FIG. 1 is a perspective view of a device for securing a piece of equipment to the area of a desk.
Figure 2:
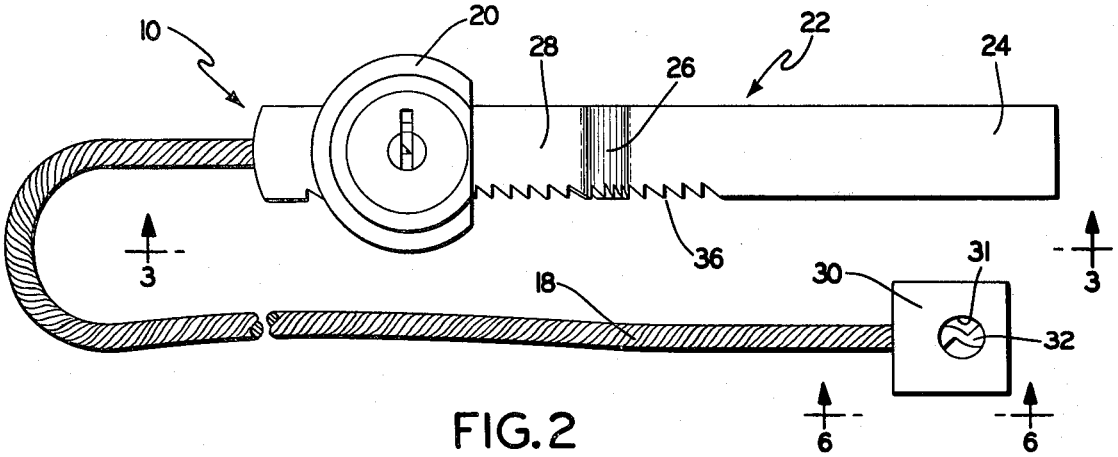
FIG. 2 is a top view of the device shown in FIG. 1.

Referring to FIG. 1, a locking device 10, in accordance with the invention, is shown for retaining a piece of office equipment 12, such as a calculator, to the area of desk 14 by securing the equipment to a fixed base 16 with a flexible cable 18. The fixed base 16 may be, but is not necessarily, a continuation of desk 14. The flexible cable 18 permits free movement of the equipment 12 on desk 14, but the equipment cannot be removed from the area of the desk without first unlocking device 10.

The device 10 comprises a plate member 22, permanently secured to the bottom of equipment 12, and a lock assembly including lock unit 20, flexible cable 18, and anchor 30. Plate member 22 comprises a first, flat region 24 (see FIG. 3) that is secured to the bottom of equipment 12, using epoxy glue, for example, and a second region 25 including a step-shaped portion 26 and an exposed, lock receiving part 28. One edge of plate member 22 contains a set of ratchet teeth 36. When lock unit 20 is slipped onto the exposed part 28 of plate member 22, the lock unit engages the set of ratchet teeth 36, and the unit cannot be removed without a key (not shown).

Anchor 30 contains an aperture 31 into which is disposed a one-way screw 32. Once anchor 30 is secured to base 16 with the one-way screw 32, the anchor cannot thereafter be removed using a screwdriver.

Referring now to FIGS. 2–6, locking device 10, in accordance with the invention, will be described in more detail. Cable 18 (FIG. 2), secured directly to anchor 30 and lock unit 20, is heavy-duty, such as aircraft cable, to prevent the cable from being easily cut. The cable 18 may be formed of steel or manganese, and for added strength, piano wire may be threaded within the cable.

Figure 3:
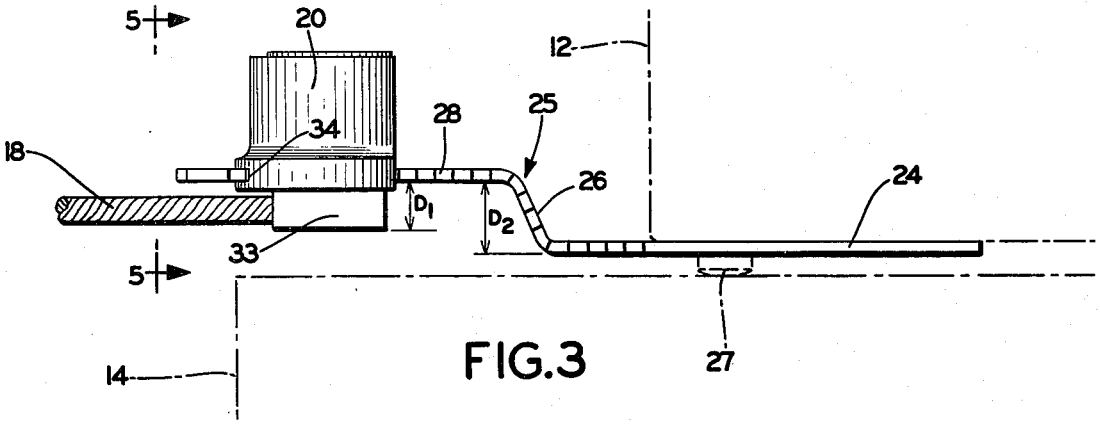
FIG. 3 is a partial side view of the device taken along the line 3—3 in FIG. 2.
Figure 4:
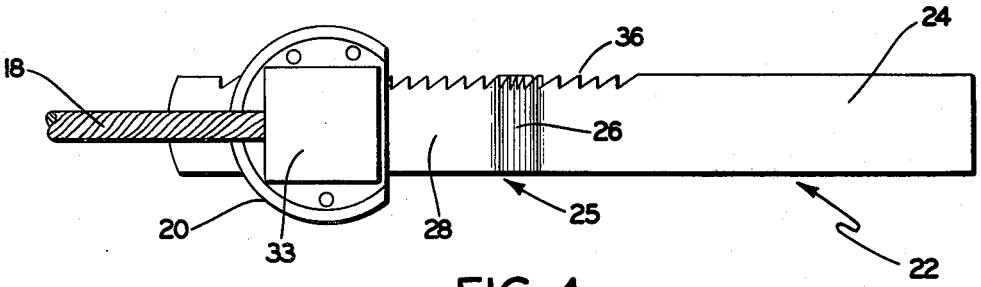
FIG. 4 is a partial bottom view of the device.
Figure 5:
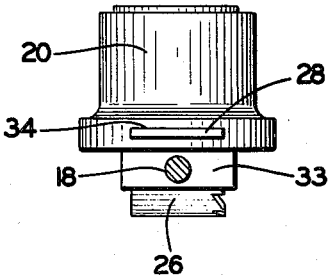
FIG. 5 is a rear view of the device taken along the line 5—5 in FIG. 3.

Region 24 of plate member 22, as best seen in FIG. 3, is planar and adapted to abut the lower surface of equipment 12. As aforementioned, the plate member 22 may be secured to the underside of equipment 12 by bonding; however, any other suitable means for permanently attaching the plate member to the equipment, such as bolting or rivoting, may be used. Thus, and of particular importance, the plate member 22 becomes an integral part of the equipment 12.

Plate member 22 is formed of a hard, relatively thin metal stock, such as steel. The equipment 12 is offset from the desk 14 with pads 27 (only one pad is shown in FIG. 3), and the bottom of equipment 12 is maintained slightly above the surface of the desk.

Lock unit 20 contains a slot 34 (FIG. 5) for receiving the exposed part 28 of plate member 22. Base 33 of lock unit 20, secured to cable 18, is located below the slot 34 by a distance $D_1$ (FIG. 3). This distance $D_1$ is less than the distance $D_2$ of step-shaped portion 26 of the plate member 22. The finite difference between distance $D_1$ and $D_2$ is of particular importance to avoid any interference between base 33 of the lock unit 20 and the surface of desk 14, particularly when the lock unit is being engaged or disengaged with respect to plate member 22.

The step-shaped portion 26 of plate member 22 is located adjacent the piece of equipment 12 for compactness. In practice, I make region 24 of the plate member 22 longer than the remainder of the plate member so that the exposed part 28 does not extend beyond the equipment to the extent that it may interfere with a wall or other structure.

Figure 6:
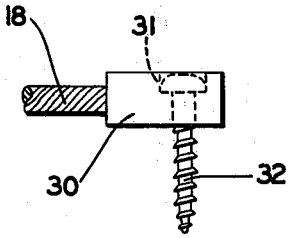
FIG. 6 is a side view of the anchor block portion of the device taken along the line 6—6 in FIG. 2.

Referring to FIG. 6, anchor 30 is countersunk at 31 to receive one-way screw 32. One-way screw 32 secures the anchor 30 to base 16 (FIG. 1) but cannot be detached from the base using a screwdriver.

In use, each of the pieces of equipment in an office or other facility is equipped with an identical plate member 22, so that each plate member and attached piece of equipment forms an integral unit. At each desk location, anchor 30 is secured to fixed base 16, and cable 18 and lock unit 20 extend to the vicinity of the equipment 12. When each piece of equipment 12 is placed in position on desk 14, the corresponding lock unit 20 is grasped and manually assembled onto the exposed part 28 of plate member 22. Locking members (not shown) within the lock unit 20 engage ratchet teeth 36 on the plate member 22. The piece of equipment 12 thus cannot be removed from the area without first unlocking the lock unit 20. However, the position of equipment 12 on the desk 14 can be adjusted to suit the user.

Preferably, each of the lock units 20 at the various desk locations in the office requires a common key for locking and unlocking the equipment, so that these operations can be conveniently carried out by a single, authorized employee. However, for maximum security, the lock unit 20 at each location may be designed to use a different key.

In this disclosure, there is shown and described only the preferred embodiment of the invention, but, as aforementioned, it is to be understood that the invention is capable of use in various other combinations and environments and is capable of changes or modifications within the scope of the inventive concept as expressed herein. For example, although lock unit 20 has been described as a key-operated lock unit in the preferred embodiment, it is to be understood that other types of locks, such as combination locks or electronically-encoded locks could be used within the scope of the present invention.

What is claimed is:

1. A compact device for restricting movement of an article relative to a base, comprising:

an elongated plate member, a first region of said member being secured to the bottom of said article, a second region of said member having a step-shaped portion between an upper horizontal part and a lower horizontal part adjacent said article, an exposed part of said second region extending parallel to and above a surface supporting said article;

a cable having first and second ends;

lock means attached to the first end of said cable for locking the first end to said upper horizontal part of said plate member; and anchor means attached to the second end of said cable for securing the second end to the base.

2. The device of claim 1, wherein the second region of said plate member includes a set of ratchet teeth; and said lock means includes a slot for receiving said plate member, said lock means engaging said ratchet teeth.

3. The device of claim 2, wherein said lock means includes a cable receiving member located beneath said slot for receiving said cable, a distance between said receiving member and said plate member being less than a height of the step-shaped portion of said plate member to provide clearance between said lock means and the surface supporting said article.

4. The device of claim 2, wherein said set of ratchet teeth is formed along only one edge of said second region.

5. The device of claim 2, wherein said lock means is key-operated.

6. The device of claim 1, wherein said anchor means includes a block containing an aperture, and a screw extending through said aperture for attaching said block to said base.

7. The device of claim 6, wherein said screw is a one-way screw.

8. The device of claim 1, wherein said plate member is bonded to said article.

9. A device for locking an office machine to a base, while permitting limited movement of the machine relative to the base, comprising:

an elongated plate member having first and second regions, the first region being secured to a surface of said office machine;

a flexible cable having first and second ends;

lock means secured to the first end of said cable for locking said first end to the second region of said plate member, said second region extending beyond the surface of said machine; and anchor means secured to the second end of said cable for anchoring the second end to said base;

wherein an edge of said plate member includes a set of ratchet teeth, and said lock means includes a slot for receiving the second region of said plate member, said lock means engaging the ratchet teeth on said plate member.

10. The device of claim 9, wherein said anchor means includes a block containing an aperture, and a screw extending through said aperture for securing said block to the base.

11. The device of claim 10, wherein said screw is a one-way screw.

* * * * *